US008550270B2

(12) United States Patent
Jäckel

(10) Patent No.: US 8,550,270 B2
(45) Date of Patent: Oct. 8, 2013

(54) CLOSURE DEVICE FOR A CONTAINER

(75) Inventor: Gerhard F. K. Jäckel, Freyung (DE)

(73) Assignee: Aptar Freyung GmbH, Freyung (DE)

( * ) Notice: Subject to any disclaimer, the term of this patent is extended or adjusted under 35 U.S.C. 154(b) by 614 days.

(21) Appl. No.: 12/523,958

(22) PCT Filed: Jan. 23, 2007

(86) PCT No.: PCT/EP2007/000555

§ 371 (c)(1),
(2), (4) Date: Oct. 28, 2010

(87) PCT Pub. No.: WO2008/098785

PCT Pub. Date: Jul. 31, 2008

(65) Prior Publication Data

US 2011/0042341 A1 Feb. 24, 2011

(51) Int. Cl.

| | |
|---|---|
| ***B65D 39/00*** | (2006.01) |
| ***B65D 47/00*** | (2006.01) |
| ***B65D 41/00*** | (2006.01) |
| ***B65D 53/00*** | (2006.01) |
| ***B65D 51/04*** | (2006.01) |

(52) U.S. Cl.
USPC ..... 215/237; 215/235; 215/354; 215/355; 220/810; 220/833; 220/834; 220/849

(58) Field of Classification Search
USPC ..... 220/810, 825, 833, 834, 849; 215/235, 215/237, 354, 355
See application file for complete search history.

(56) References Cited

U.S. PATENT DOCUMENTS

| | | | | |
|---|---|---|---|---|
| 5,573,127 | A * | 11/1996 | Takahashi et al. | 215/237 |
| 6,474,515 | B1 * | 11/2002 | Ladina et al. | 222/481.5 |
| 2006/0163188 | A1 * | 7/2006 | Lagler | 215/235 |
| 2007/0000955 | A1 * | 1/2007 | Barre et al. | 222/484 |

FOREIGN PATENT DOCUMENTS

| | | | |
|---|---|---|---|
| EP | 1 211 185 | A1 | 6/2002 |
| EP | 1 332 097 | B | 8/2006 |
| GB | 2 318 574 | A | 4/1998 |
| WO | WO 03/086892 | A1 | 10/2003 |

OTHER PUBLICATIONS

International Search Report for corresponding PCT Application No. PCT/EP2007/000555 dated Nov. 23, 2007.

* cited by examiner

*Primary Examiner* — Anthony Stashick
*Assistant Examiner* — Madison L Poos
(74) *Attorney, Agent, or Firm* — Wood, Phillips, Katz, Clark & Mortimer

(57) ABSTRACT

The invention relates to a closure device for a container, comprising a base element that can be attached to an opening of the container, and a lid, such as a cover, that can be disposed back and forth between a completely closed, and a completely open, position, wherein the closure device is configured such that the lid has at least one defined intermediate position between the completely closed and the completely open positions, and wherein the closure device has at least one degassing channel, which is sealed off in the completely closed position of the lid and enables pressure compensation between a side of the closure device facing the interior of the container and the surrounding area in the intermediate position of the lid.

3 Claims, 10 Drawing Sheets

CLOSURE DEVICE FOR A CONTAINER

FIELD OF THE INVENTION

The invention relates to a closure device for a container, particularly for bottles, wherein this closure device comprises a base element which can be fixed or mounted on an opening of the container and has a dispensing opening for the dispensing of media located in the container. Further, the closure device comprises a lid which can be moved back and forth between a completely closed and a completely open opening, in order to enable the dispensing particularly of a flowable medium from the container.

BACKGROUND OF THE INVENTION

Closure devices are known in manifold shapes and are usually produced from a plastic material, they can also be produced from other materials, e.g. metals, however. A base element typically comprises a device for fixing the base element to an opening of the container, for example to a bottle neck, wherein particularly an internal thread can be provided, so that the closure device can be screwed onto the bottle neck.

A spout preferably extends from the base element, particularly a dome-shaped spout, which can also be enclosed by the mouth of the person drinking when drinking from the container for example.

Particularly in the cases in which liquids to which carbonic acid has been added can be accommodated in the container, an increased pressure can develop in the container. Even in the case of liquids to which carbonic acid has not been added, a pressure difference can be built up, for example if the container is transported at different altitudes, as is the case during mountain hiking for example. Even weather changes can already lead to corresponding pressure differences. In the case of opening the closure device, that is to say when opening the lid, it can therefore come to pass that the pressure compensation takes place very suddenly, wherein the medium stored in the container might undesirably flow out of the container.

It is an object of the present invention to provide an improved closure device, in the case of which, particularly this undesirable flowing out of the product located in the container is prevented or at least the amount of the medium flowing out is remarkably reduced.

This object is achieved by means of a closure device according to the claims.

BRIEF SUMMARY OF THE INVENTION

According to the invention, the closure device is constructed in such a manner that the lid has at least a defined intermediate position between the completely closed and the completely open position, wherein the closure device has at least one degassing channel, which is closed off in the completely closed position of the lid and which, in the intermediate position of the lid, enables a pressure compensation between the side of the closure device which is to be brought to face the container interior and the ambiance. With a closure device according to the invention of this type, the lid can be opened essentially in a two step process, in a first step from the completely closed position into the defined intermediate position, and in a second step from the defined intermediate position into a completely open position.

A closure device has a defined intermediate position in the sense of this invention for example if during the opening procedure of the lid from the completely closed into an open position, there is at least one intermediate position, via which the opening procedure of the lid, at least in the event of a conventional operation or actuation, can not be carried out in a manner which is continuous and even, that is to say there is a position which differentiates itself in any manner with respect to the opening procedure and the handling of the user during the opening of the lid. The differentiation can be realised by an increased exertion of force, by a change in the direction of movement of the lid during opening, even only for a short time, by the actuation of a device, for example by the displacement of a bar which for example only allows the movement of the lid from the closed position into the defined intermediate position and only allows a movement beyond that by means of actuation of the bar or another actuation element however, or by any other measures.

The user therefore automatically only opens the lid of the closure device into the intermediate position in the first instance, in which intermediate position, at least in the case of a normal use of the device, the opening procedure automatically stops, if appropriate also only for a very short period of time, or is at least delayed, and in which intermediate position a pressure compensation can take place automatically via the at least one degassing channel provided. On the basis of the fact that only the degassing channel is open, whilst the dispensing opening is essentially closed as before, no medium whatsoever escapes at this point in time, rather a controlled pressure compensation takes place without an undesired dispensing of the medium contained in the container.

In a second step, the user can then move the lid from the intermediate position into a completely open position. As at this point in time a pressure compensation is at least substantially completed, it is ensured that medium can in no way escape. It is pointed out that the provision of the defined intermediate point can be configured to a greater or lesser pronounced extent so that even the closure device can particularly be adapted to the media to be stored in the container. If a carbonic-acid-containing liquid is stored in the container for example, a closure device according to the invention can preferably be used, in the case of which the intermediate position is more strongly configured, in particular for example the exertion of force for getting past the defined intermediate position deviates to a greater extent from the exertion of force required otherwise during the opening of the lid, so that the lid automatically remains in the defined intermediate position for longer in the case of a usual opening procedure of the user.

It should be pointed out at this point that only a very short period of time is required for a pressure compensation which may be required in the intermediate position of the lid, so that the only very short resting time of the lid in the intermediate position during the opening procedure is in no way conceived for the user as being disturbing or burdensome. Further, the user in no way has to let caution prevail, as the pressure compensation takes place automatically in the defined intermediate position. Further, it is to be pointed out that on the basis of the provision of a defined intermediate position, even if this is only taken up automatically for an extremely short time, for example even only for fractions of seconds, the possibility is created for the user to react in the case of a very high pressure difference which must be compensated. If the user moves the lid, namely into the defined intermediate position, and there is a very high pressure difference, for example in the case of carbonic-acid-containing drinks which have been shaken previously, the pressure compensation which takes place automatically is also often acoustically noticeable for the user, the degassing channel in particular can also be constructed in such a manner for example that a pressure compensation will consciously take place in an acoustically noticeable manner. Even if this only takes place in fractions of seconds, it is typically sufficient for the user in order then, as a reflex as it were, to pause in the opening procedure.

In the case of a preferred embodiment of the closure device, the latter comprises a stop device which is preferably constructed in such a manner that during the movement of the lid from the completely closed position into the completely open position, a higher exertion of force is required in order to move the lid beyond the defined intermediate position. This increased exertion of force ensures that during the opening movement, the lid automatically rests in the defined intermediate position at least for a short period of time, in order to guarantee the required pressure compensation. Further, the user automatically recognises this defined intermediate position, wherein even in the case that a particularly high pressure difference must be equalised, they can keep the lid in the intermediate position for a longer period of time until the pressure compensation is completed. Here, they are aided by the automatic "discovery" of the intermediate position, for example by means of the increased exertion of force.

In the case of another embodiment, a stop device is constructed in such a manner that the movement process is essentially non-continuous during the opening of the lid, that is to say around the region of the defined intermediate position, the movement process, for example the movement direction, must be changed slightly and at least for a short period of time. Another possibility for a stop device consists for example in providing a bar or another element which must additionally be actuated in order to get past the defined intermediate position. It is also possible that a stop device is constructed in such a manner that a predetermined pressure must be exerted at a certain point of the closure device in order to get past the defined intermediate position, which is a preferred embodiment, particularly in the case of the closure devices typically produced from plastic, which are at least partially elastic.

A stop device in the sense of this invention is therefore to be understood in a broadest possible scope and also comprises delay devices, locking devices, bars, actuation elements or other devices which ensure in any manner that the movement procedure when opening the lid for getting past the defined intermediate position, at least in the case of a movement from the closed position into the open position, is delayed, inhibited, impeded or influenced in another manner.

Preferably both the base element and the lid in each case comprise at least one stop element, which stop elements are constructed in such a manner that they at least partly abut one another in the defined intermediate position of the lid. In particular, at least one of the stop elements is in this case constructed in such a manner that it is elastically yielding. These embodiments of the stop element(s) are a particularly simple and effective realisation of the closure device with a defined intermediate position and particularly with an intermediate position which, at least during the opening procedure, can only be traversed by means of a higher exertion of force by the user.

In the case of a particularly preferred embodiment, the base element comprises a spout which is preferably constructed in an essentially dome-shaped manner, wherein a bead-like element is preferably provided on the external side of the spout, at least over a partial region of the circumference. This bead-like element can serve as a stop element or as a resistance element which interacts with an element of the lid so that the defined intermediate position is provided in a particularly preferred manner.

It should be pointed out at this point that a bead-like element of this type can also be provided at other points on the base element, particularly also at an internal region of the spout. Further, it can also be arranged at various height positions of the spout, wherein it is preferably arranged at an upper position or even at the upper edge of the spout.

The bead-like element can, in a particular embodiment, be arranged over the entire circumference of the spout. It is however also possible that the bead-like element merely extends over partial angular ranges of the spout, preferably however, not less than 90 degrees or alternatively at least not less than 45 degrees of the circumference. It is also possible that a plurality of individual bead-like elements are provided, which extend at least in certain regions of the circumference of the spout. In this case, the individual elements can also extend over essentially small partial angular ranges, for example 10° to 5°, or even be constructed in an essentially punctiform manner.

In the case of a further embodiment, it is provided that the lid comprises a sealing or guiding element, which, in the completely closed position of the lid, is positioned at least partially around the spout or in the spout, wherein this sealing or guiding element preferably comprises at least one stop element.

This stop element can be realised as a locking element, as a bead, as a barb or in various different embodiments. Preferably here, it is a partially elastic element.

In the case of a provision of a stop element or a similar element both on the lid and on the base element, it is sufficient that only one of the elements is constructed at least partially elastically. In a preferred embodiment, both elements are at least partially elastically constructed.

In the case of a preferred embodiment, the lid comprises a sealing element which in the closed position of the lid projects into the opening of the spout or engages into the latter and thus interacts with the spout so that the dispensing opening is closed off in a sealing manner.

It is preferably provided that at least one recess is provided on the external side of such a sealing element, which recess acts as a degassing channel. In this case, this recess which acts as a degassing channel is constructed in such a manner that, in the completely closed position of the lid, it does not interact with the associated element, particularly a seal, but in the intermediate position, regions of the recess which acts as a degassing channel are located in the region of the associated sealing elements of the spout or of the base element, so that a pressure compensation is possible. The at least one recess can, in one embodiment, be constructed in such a manner that the wall thickness or material thickness of the sealing element is only reduced, but, in the case of another embodiment, it is also possible that a limited partial region of the sealing element is actually completely recessed, so that for example a slot or the like is therefore created in the sealing element.

It should be pointed out at this point that in one embodiment, all elements are constructed in such a manner that an open degassing channel is already present in the intermediate position of the lid. In another embodiment, it is however possible that corresponding sealing elements abut one another as before, but these sealing elements are constructed in such a manner that the degassing channel is opened even in the case of a relatively small differential pressure which is to be determined.

A degassing channel in the sense of this invention does not have to fulfil any particular geometric requirements, it must merely be ensured that a pressure compensation between a side of the closure which faces the container interior and the surroundings is enabled, at least if the pressure difference between the container interior and the surroundings exceeds a certain value.

In one embodiment, only one recess which acts as a degassing channel is provided. In a preferred embodiment however, a plurality of recesses, particularly for example three recesses, are provided.

The provision of a plurality of recesses which can work in parallel ensures that, in a shorter time, a larger pressure difference can be relieved, wherein it is at the same time ensured that the product located in the container does not escape. In particular, smaller flow rates and a higher possible flow within the degassing channel are thereby enabled, which likewise strengthens the above-mentioned effect.

In a special embodiment, the lid comprises at least one web on its inner side, on which web a stop element is constructed or which itself serves as stop element, wherein this web can either be constructed as an elastic element itself or alternatively comprises an elastic element.

In a particularly preferred embodiment, the closure device comprises a flip-top lid which can be fixed to the base element by means of at least one hinge, so that it can be pivoted from the completely closed position, via the defined intermediate position into a completely open position by means of a pivoting movement.

In a particularly preferred embodiment, the closure device is constructed in such a manner that the defined intermediate position is achieved after a pivoting of the lid of approx. 5 degrees to 20 degrees, preferably of approx. 5 degrees to 15 degrees and in particular in the case of a pivoting of approx. 10 degrees. This leads to a particularly flexible and convenient operation of the system for the user. Further, the corresponding elements and parts of the closure device can be utilised particularly well for these angles, so that the production of the closure device is cost effective and further, the entire system operates particularly reliably.

In a particularly preferred embodiment with a flip-top lid, the stop device or the stop elements is/are essentially arranged on a side facing away from the hinge. Even this serves a convenient and safe configuration of the closure device which is constructively simple and inexpensive to produce, which is of great importance particularly in the case of such mass-produced products.

The closure device according to the invention is not limited to flip-top lids however, yet this constitutes a preferred embodiment, rather it is also possible to provide what are known as "push-on caps" which are not removed in a pivoting movement, but rather are removed essentially linearly from the base element. It is also possible to provide a lid which can be fixed on the base element by means of a screwing or rotational movement.

In the case of a lid which can be removed essentially linearly upwards from the base element, corresponding interacting elements, particularly stop elements are provided at least at two, particularly opposite positions in the circumferential direction, in a particularly preferred embodiment even at three or more positions which are preferably arranged substantially evenly distributed around the circumference. It is thereby ensured that the lid is moved automatically and evenly, with respect to the circumferential direction, from the completely closed position into the intermediate position.

BRIEF DESCRIPTION OF THE DRAWINGS

These and further features and advantages become even clearer on the basis of the following drawings which schematically show preferred embodiments of the closure device according to the invention:

FIG. 3 shows the embodiment shown in FIGS. 1 and 2, wherein the lid is located in a completely open position;

DETAILED DESCRIPTION OF THE PREFERRED EMBODIMENTS

Figure 1:
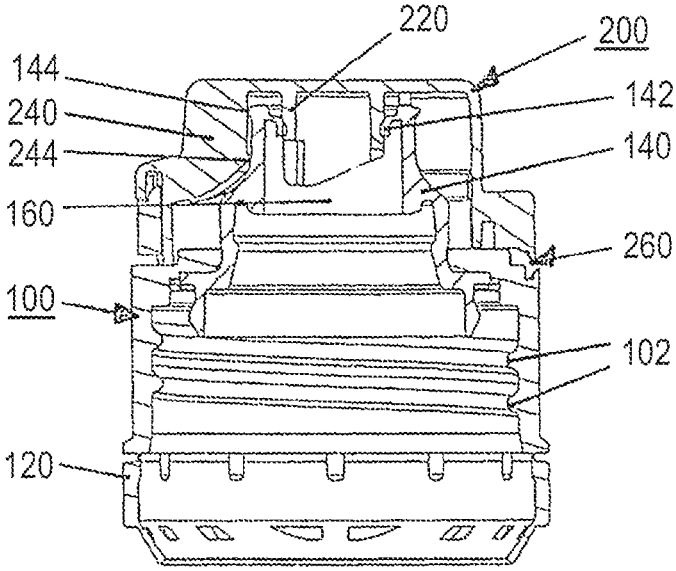
FIG. 1 shows a first embodiment of a closure device according to the invention in cross section, wherein the lid is located in the completely closed position.

FIG. 1 schematically shows a first embodiment of a closure device according to the invention in a cross-sectional representation. The closure device comprises a base element 100 and a lid 200 which is constructed as a flip-top lid, wherein it is fixed to the base element 100 by means of a hinge device 260 and can be pivoted around the latter from a completely closed position, as is shown in FIG. 1, via an intermediate position, see FIG. 2, into a completely open position, see FIG. 3.

The base element 100 is constructed essentially cylindrically and can be placed onto an opening of a container, particularly a bottle, wherein an internal thread 102 is provided for screwing onto a complementary external thread of a container.

A spout 140 is inserted in the base element 100, which spout is constructed in an essentially dome-shaped manner and provides a dispensing opening 160 for dispensing a product contained in the container, particularly a flowable medium. Base element and spout can also be constructed in one-piece.

The flip-top lid 200 comprises a sealing element 220 which is essentially a cylindrical web which is constructed on the inner side of the lid 200, wherein this web projects into the dispensing opening 160 of the spout 140 in the completely closed position of the lid 200 shown in FIG. 1.

On its inner side, the spout 140 comprises sealing lips 142, which interact with the sealing element 220 of the lid in the dosed position of the lid and completely seal the dispensing opening 160.

The spout 140 comprises an annular bead 144 at its outer upper edge, which serves as stop element, while the lid has an essentially circular-segment-shaped bead 244 which is arranged on a centering ring 240, which is likewise constructed in a circular-segment-shaped manner. The interaction between the bead 144 on the spout 140 and the bead 244 on the centering ring 240 is particularly visible in FIG. 2 which is described below. Beads 144 and 244 each function individually as a stop element, and they function collectively as a stop device.

Figure 2:
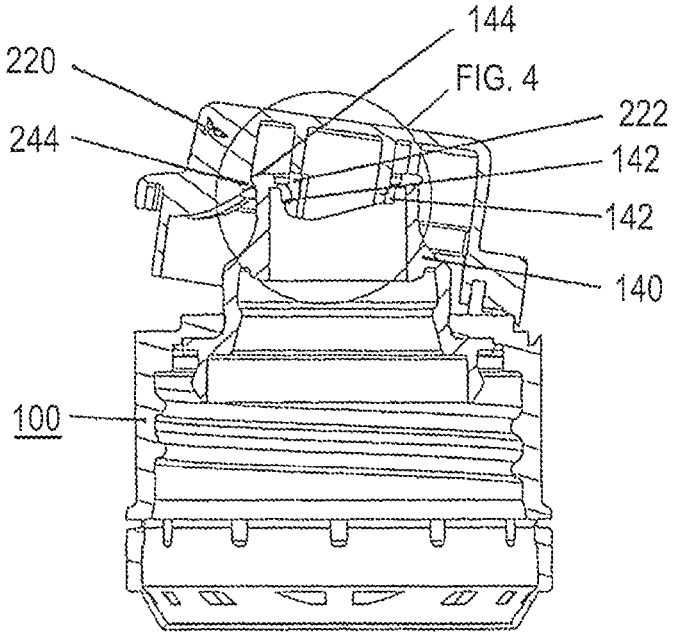
FIG. 2 shows the embodiment illustrated in FIG. 1, wherein the lid is located in the defined intermediate position.
Figure 4:
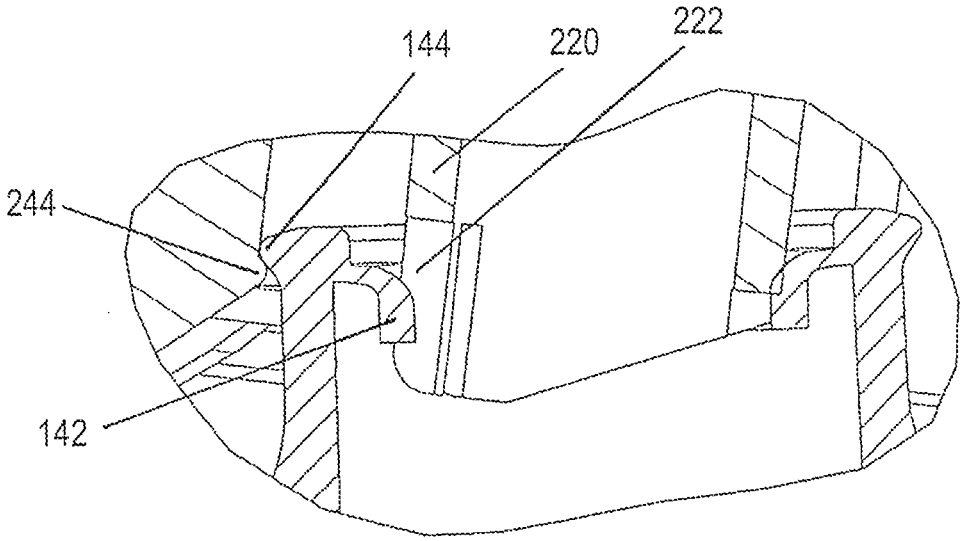
FIG. 4 shows an enlarged partial cross sectional view of the region in FIG. 2 that is enclosed in the circle designated "FIG. 4"

FIG. 2 shows the embodiment of the closure device according to the invention shown in FIG. 1, wherein the lid 200 is located in the defined intermediate position there. In this intermediate position, in which the lid 200 has been pivoted out of its completely closed position by approximately 10 degrees, the bead 244 of the lid 200 abuts the bead 144 of the spout 140, so that an increased exertion of force is required in order to move the two interacting bead elements 144, 244 past one another. As can likewise be seen well in FIG. 2 and particularly in the enlarged representation in FIG. 4, the lid 200 is pivoted in the defined intermediate position in such a manner that the sealing lip 142 lies in the region of a recess 222 in the sealing element 220, so that a degassing channel is opened. In this position, an overpressure which may if appropriate be present between the sealing lip 142 and the sealing element 220 can therefore leak out, namely by means of the recess 222 which serves as a degassing channel, while an escaping of the product located in the container is still prevented.

Figure 3:
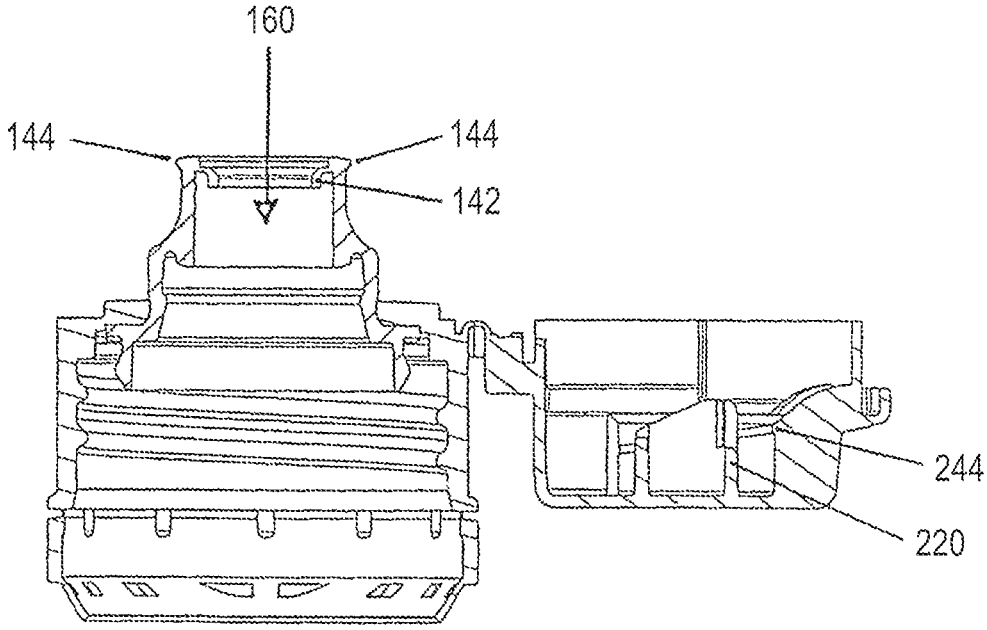
FIG. 3 is a cross-sectional view taken along the plane 3-3 in FIG. 5.

FIG. 3 shows the embodiment illustrated in FIG. 1 and FIG. 2, in which embodiment the lid is located in a completely open position, however. The lid was pivoted by approx. 180 degrees in the position shown in FIG. 3. A completely open position is already present in the case of smaller pivoting angles however. As can be seen in FIG. 3, the dispensing opening 160 is now completely open, so that a dispensing of a product is enabled.

Figure 5:
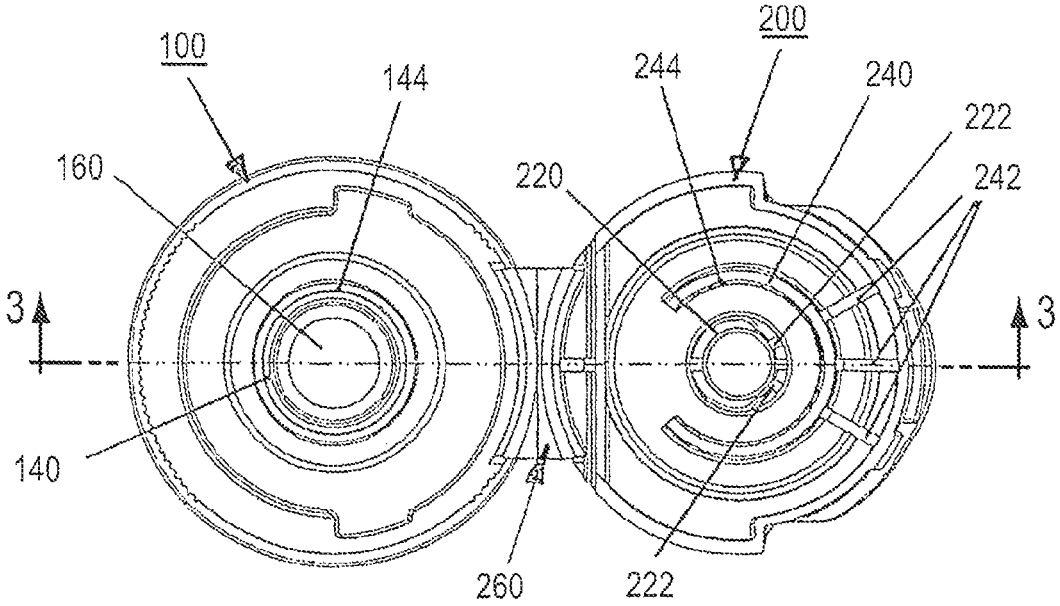
FIG. 5 shows a plan view of the embodiment illustrated in FIG. 3 with a completely open lid.
Figure 6:
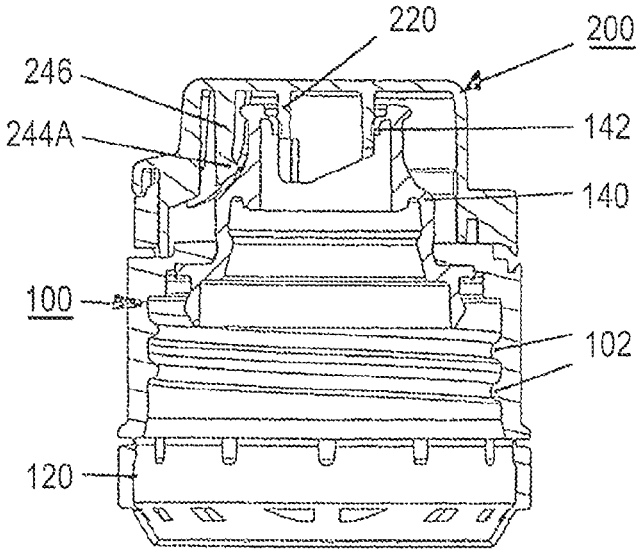
FIG. 6 shows a second embodiment of a closure device according to the invention in cross section, wherein the lid is located in the completely closed position.

FIG. 5 shows a plan view onto FIG. 3 from above, wherein here the dispensing opening 160 can very clearly be seen, which dispensing opening is surrounded by a spout 140 or is formed by the spout, on the external side of which spout the annular bead 144 is provided. The lid 200 is connected to the base element 100 by means of the hinge 260 which can be seen well.

FIG. 5 also clearly shows the cylindrical sealing element 220 located in the lid 200, which sealing element extends from an upper wall of the lid 200, wherein overall three recesses 222 are provided in the sealing element 220, which recesses serve as degassing channels.

Further, FIG. 5 very clearly shows the centering ring 240, which is constructed in a circular-segment-shaped manner or forms a partial cylinder and has a bead 244 on its inner side, which bead interacts with the bead 144 on the external side of the spout 140 of the base element 100 in the defined intermediate position, as is described above.

The centering ring 240, which is constructed in a cylindrical manner, is stabilised by means of three webs 242 on the lid 100, wherein the webs 242 are consciously arranged on a side essentially opposite the hinge, as a particularly clear interaction of the bead 244 with the bead 144 takes place in this region.

As can be seen in the FIGS. 1, 2 and 3, the closure device according to the invention comprises a tamper-evident band 120, as has been described for example in the German patent application with the Application Number DE 10 2006 011 445.0, which application was likewise filed by the applicant of this application.

FIGS. 6 to 10 show, in comparable representations, a second embodiment of a closure device according to the invention, which embodiment essentially corresponds to the closure device shown in the FIGS. 1 to 5. Identical and similar elements have therefore been provided with identical reference numbers. Further, reference is made to the above description in order to avoid repetitions.

The second embodiment shown in FIGS. 6 to 10 comprises a web element 246 which extends from an upper edge of the lid 200 and extends in its inner region, wherein the web element 246 comprises a bead-shaped elevation, or bead, 244A which, in a manner similar to in the case of the first embodiment, interacts with the annular bead 144, which is provided in the external region of the spout MO, wherein the annular bead 144 is constructed as in the first embodiment. Beads 144 and 244A each function individually as a stop element, and they function collectively as another embodiment of a stop device.

Figure 7:
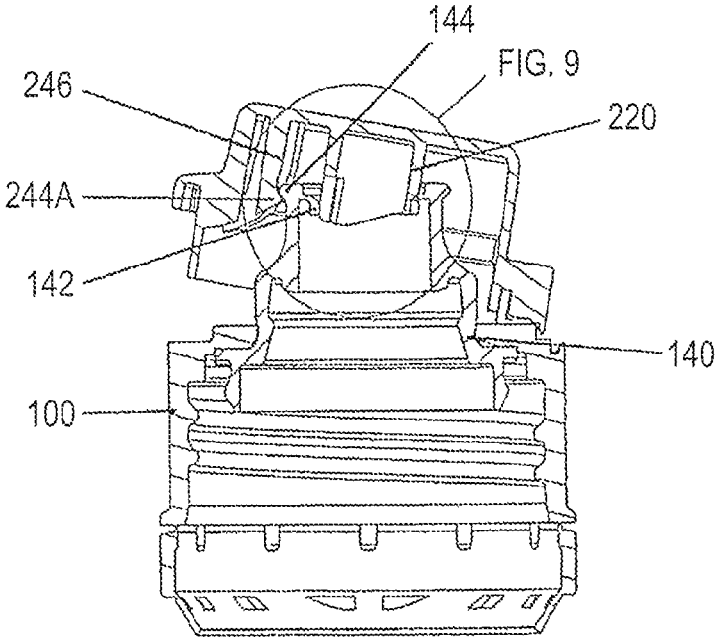
FIG. 7 shows the embodiment illustrated in FIG. 6, wherein the lid is located in the defined intermediate position.
Figure 8:
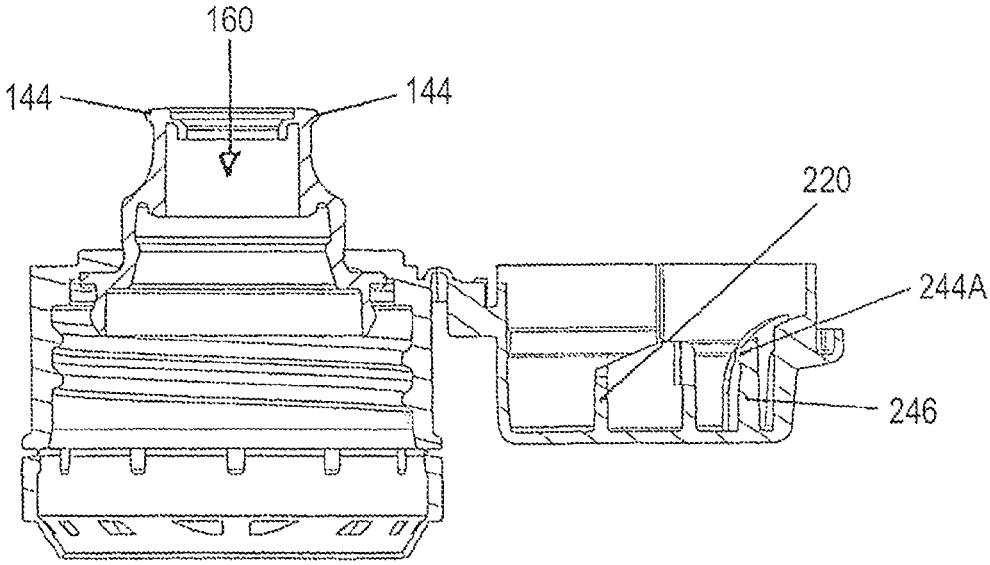
FIG. 8 is a cross-sectional view taken along the plane 8-8 in FIG. 10, and FIG. $ shows the embodiment shown in FIGS. 6 and 7, wherein the rid is located in a completely open position.
Figure 9:
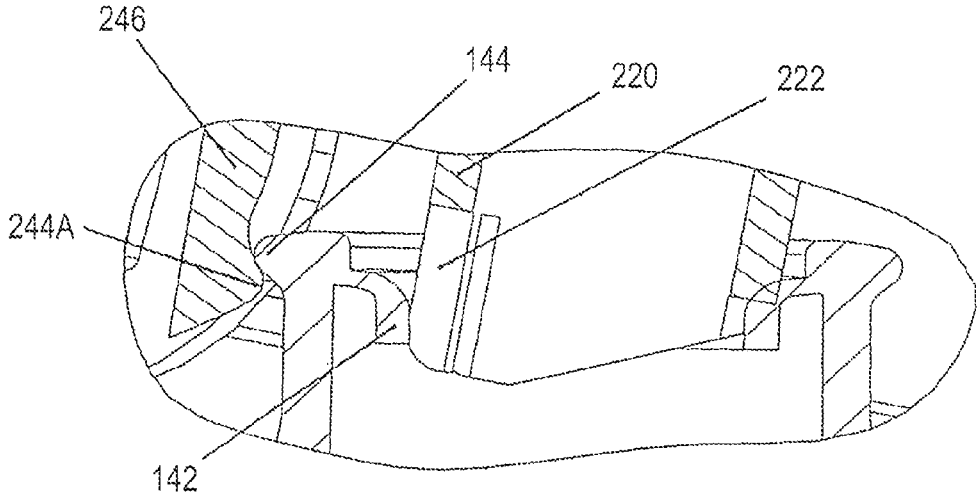
FIG. 9 shows an enlarged partial cross-sectional view of the region in FIG. 7 that is enclosed in the circle designated "FIG. 9"

In FIG. 7, which shows the lid in an intermediate position, the interaction of the bead 144 of the spout 140 and the bead 244A of the web element 246 becomes particularly clear: The web element 246 is constructed in such a manner that it can be pushed elastically essentially radially outwards, to which end an increased force is required however, so that, for the user, the defined intermediate position is automatically recognised or becomes automatically "effective" during the opening procedure.

Figure 10:
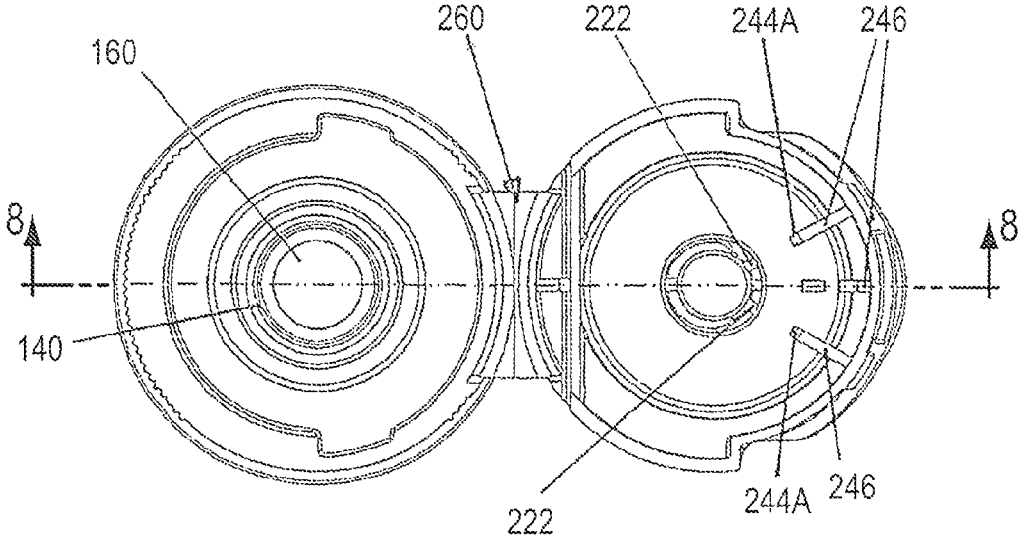
FIG. 10 shows a plan view onto the embodiment illustrated in FIG. 8 with a completely open lid.
Figure 11:
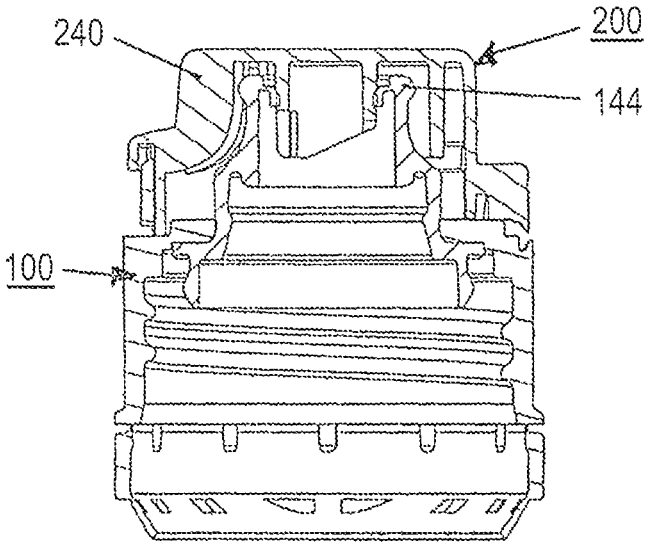
FIG. 11 shows a third embodiment of a closure device according to the invention in cross section, wherein the lid is located in the completely closed position.
Figure 12:
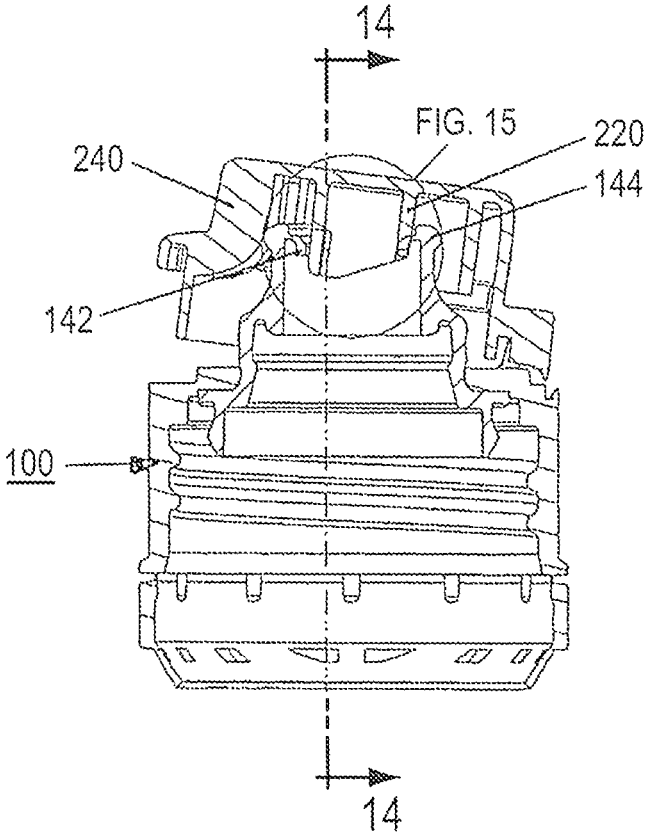
FIG. 12 shows the embodiment illustrated in FIG. 11, wherein the lid is located in the defined intermediate position.
Figure 13:
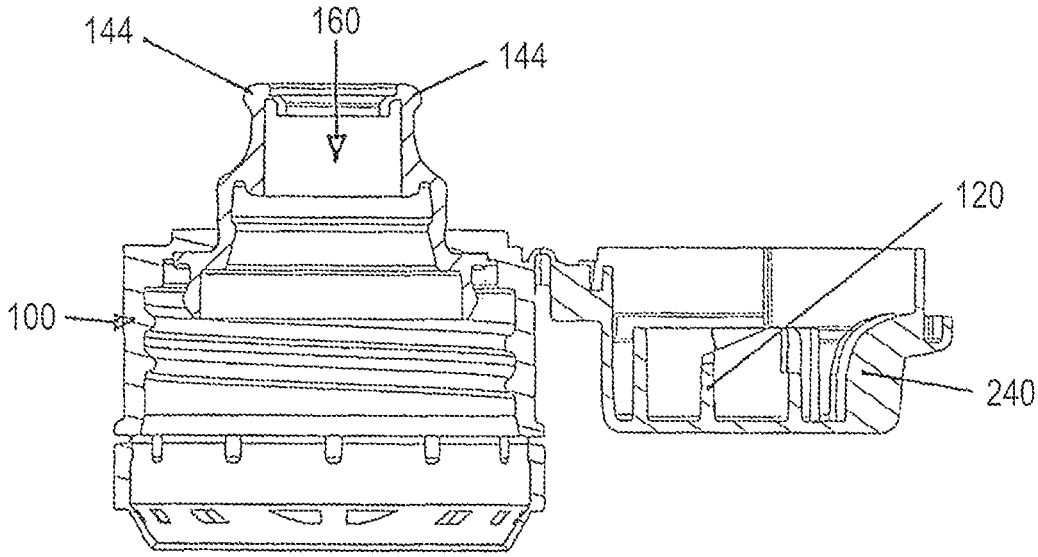
FIG. 13 shows the embodiment shown in FIGS. 11 and 12, wherein the lid is located in a completely open position.

FIG. 10 very clearly shows that the second embodiment has three webs 246 overall, which webs are arranged at positions which are essentially radially opposite the hinge 260, wherein the webs 246 are arranged at an angular spacing of approx. 30 degrees to one another.

FIGS. 11 to 15 show, in comparable representations, a third embodiment of a closure device according to the invention, which embodiment essentially corresponds to the closure device shown in the FIGS. 1 to 5. Identical and similar elements have therefore been provided with identical reference numbers. Further, reference is made to the above description in order to avoid repetitions.

The third embodiment illustrated in FIGS. 11 to 15 essentially corresponds to the first embodiment, wherein instead of the bead provided there (244, see FIG. 1) an extension element 244B (FIG. 14) is provided, which serves as a kind of barb and which interacts with the bead 144 arranged on the spout 140 in a similar manner, as this has been described in the context of FIGS. 1 to 10. Beads 144 and 244B each function individually as a stop element, and they function collectively as another embodiment of a stop device.

Figure 14:
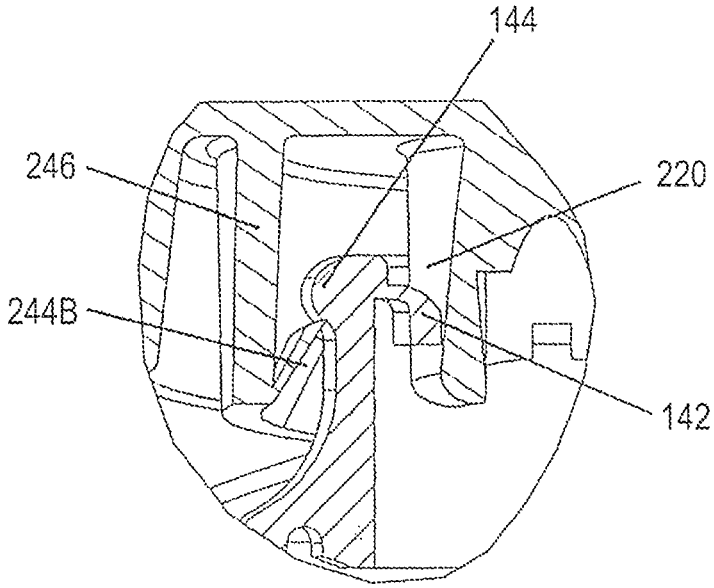
FIG. 14 shows an enlarged partial cross-sectional view taken along the plane 14-14 in FIG. 12.
Figure 15:
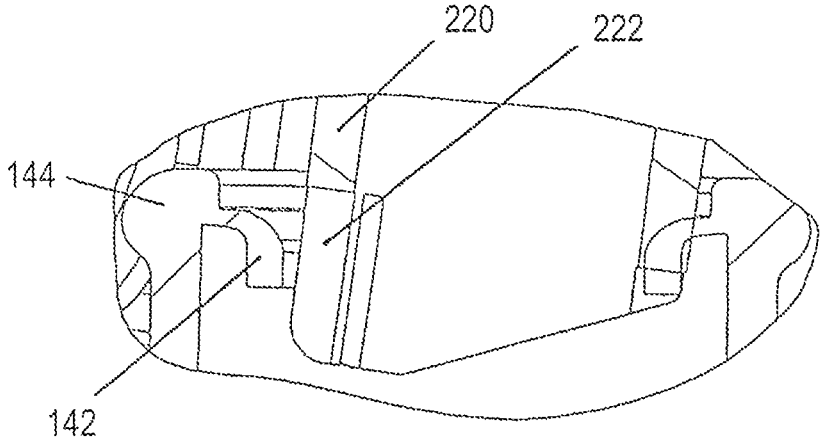
FIG. 15 shows an enlarged partial cross-sectional view of the region in FIG. 12 that is enclosed in the circle designated "FIG. 15"

FIG. 14 shows the region of discharge in the intermediate position an enlarged representation. It becomes very clearly visible here how the extension element 244B interacts with the bead 144 on the spout, whilst, as before, the sealing lip 142 interacts with a partial region of the sealing element 220, in order to ensure that no product escapes. FIG. 14 shows a region of the sealing element 220 here which is not provided with a recess 222, whilst FIG. 15 in contrast shows a region, on which one of the three recesses 222 is present, so that in the intermediate position shown, pressure compensation is possible via the degassing channel.

FIGS. 16 to 20 show, in comparable representations, a fourth embodiment of a closure device according to the invention, which embodiment essentially corresponds to the closure device illustrated in FIGS. 6 to 10. Identical and similar elements have therefore been provided with identical reference numbers. Further, reference is made to the above description in order to avoid repetitions.

Figure 16:
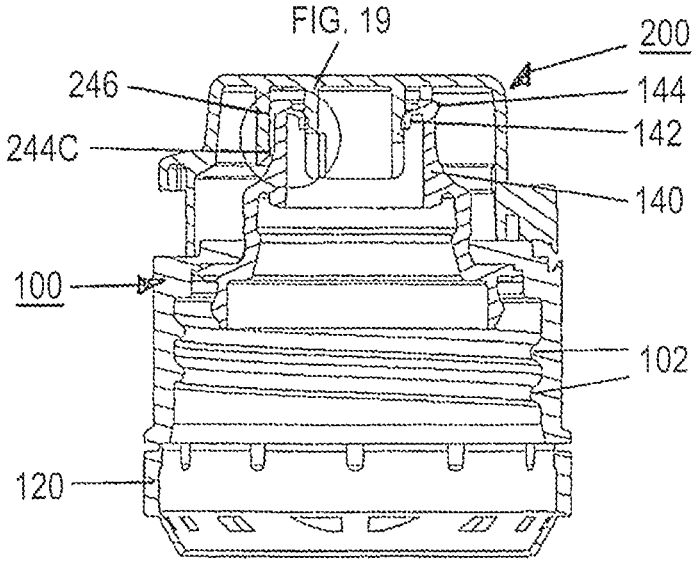
FIG. 16 shows a fourth embodiment of a closure device according to the invention in cross section, wherein the lid is located in the completely closed position.
Figure 17:
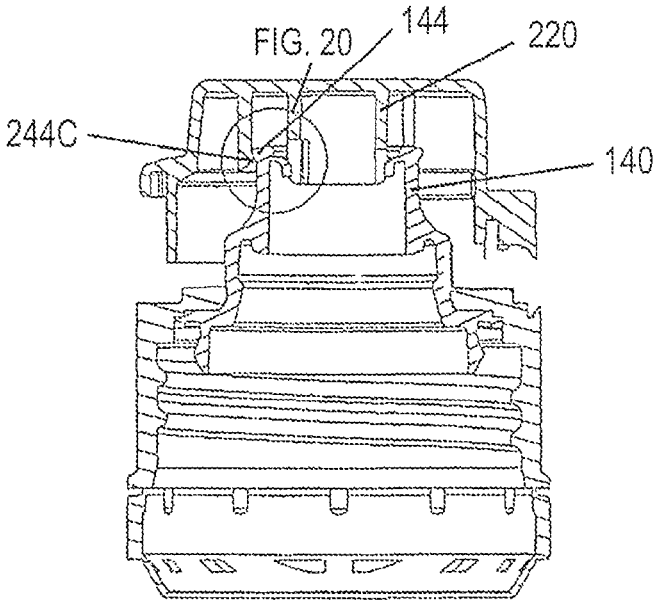
FIG. 17 shows the embodiment illustrated in FIG. 16, wherein the lid is located in the defined intermediate position.
Figure 18:
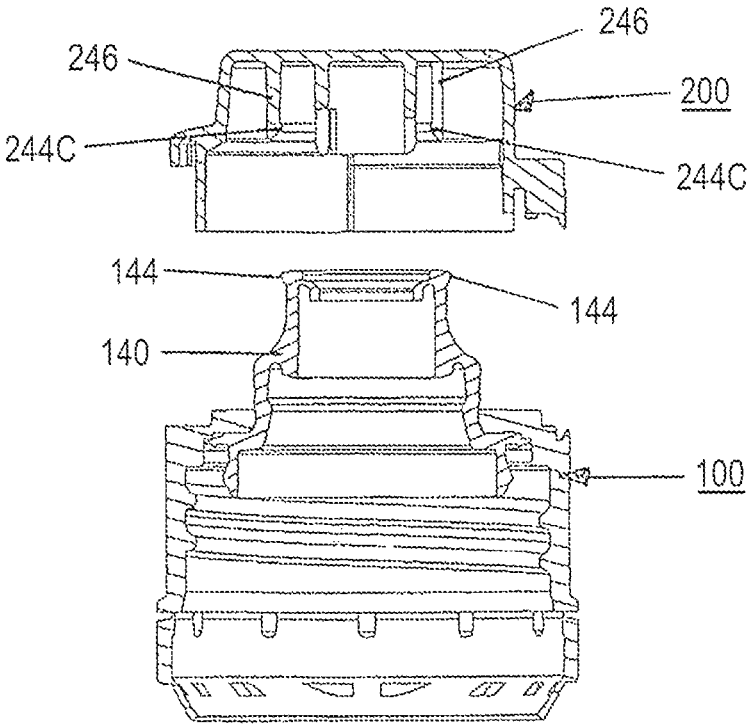
FIG. 18 shows the embodiment shown in FIGS. 16 and 17, wherein the lid is located in a completely open position.

The embodiment shown in FIGS. 16 to 20 has, in contrast with all previous embodiments, a lid 200 constructed as a push-on cap which is not pivoted from its completely closed position, see FIG. 16, into its completely open position, see FIG. 18, but rather is essentially removed linearly upwards, wherein the defined intermediate position is shown in FIG. 17.

Even this embodiment comprises, as can be seen in FIG. 16, a base element 100 with an outlet, which in the illustrated embodiment, has the form of, and functions as, a spout 140, and which has sealing elements 142 at its upper inner side. The lid 200 is provided with a web 246, which has a bead-shaped elevation, or bead, 244C which interacts with an essentially annular bead 144, which is provided, at the upper end of the external side of the spout 140, as can be seen in particular in FIG. 17. Beads 144 and 244C each function individually as a stop element, and they function collectively as another embodiment of a stop device.

FIG. 17 shows the embodiment illustrated in FIG. 16, wherein the lid 200 constructed as a push-on cap is located in the defined intermediate position in which the bead 244C, which is provided on the lid, interacts with the bead 144, which is provided on the spout 140, wherein the bead 244C abuts the bead 144 so that the defined intermediate position is achieved. It is only possible by means of an increased application of force or a slight displacement of the movement direction to get past the defined intermediate position shown in FIG. 17, in order to move the lid 200 into its completely open position shown in FIG. 18, in which position the lid 200 is completely separated from the base element 100.

Figure 19:
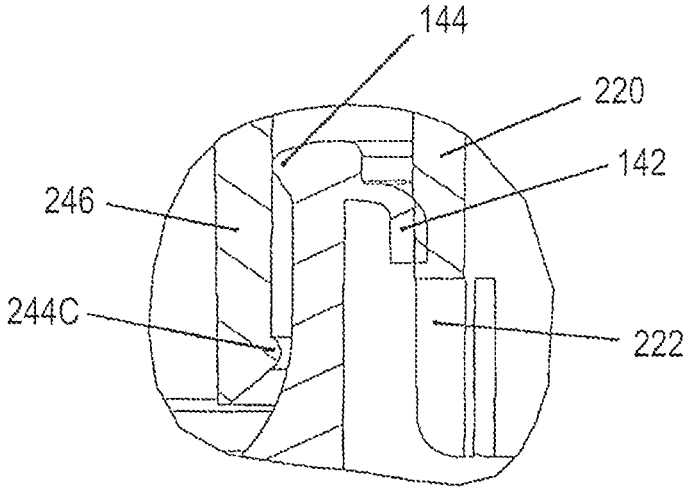
FIG. 19 shows an enlarged partial cross-sectional view of the region in FIG. 16 that is enclosed in the circle designated "FIG. 19"

FIG. 19 shows an enlarged view of the fourth embodiment in the position shown in FIG. 16, that is to say in the position in which the lid is completely closed, wherein FIG. 19 clearly shows that the bead 244C of the web 246 does not interact with the bead 144 of the spout 140.

Figure 20:
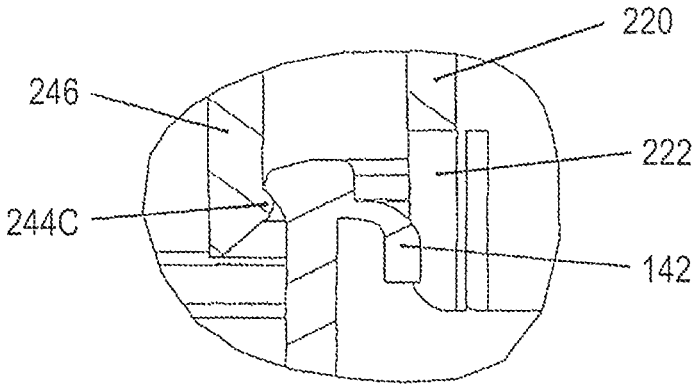
FIG. 20 shows an enlarged partial cross-sectional view of the region in FIG. 17 that is enclosed in the circle designated "FIG. 20".

FIG. 20 shows an enlarged illustration from FIG. 17, wherein the lid 200 is located in the defined intermediate position. The bead 244C of the web 246 abuts the bead 144 of the spout 140 and defines the intermediate position, which, as described above, can only be passed with an increased exertion of force or another movement direction.

FIG. 20 also clearly shows the recess 222 in the sealing element 220, so that a degassing channel which enables a pressure compensation is defined between sealing lip 142 and sealing element 220.

The features of the invention disclosed in the previous description, in the drawing as well as in the claims can be significant, both individually and in any desired combinations, for the realisation of the invention in its various embodiments.

What is claimed is:

1. A closure device for a container with a base element which can be fixed on an opening of the container and which has a dispensing opening, and with a lid which can be moved back and forth between a completely closed and a completely open position, characterised in that the closure device is constructed in such a manner that the lid has at least one defined intermediate position between the completely closed and the completely open position, wherein the intermediate position of the lid is defined by a location of the lid outwardly relative to the base element compared with the location of the lid relative to the base element when the lid is in the completely closed position, and wherein the closure device has at least one degassing channel, which is closed in the completely closed position of the lid and which, in the defined intermediate position of the lid, enables a pressure compensation between a side of the closure device which is to be brought to face an interior of the container and the ambient exterior environment, the closure device further characterised in that it comprises a stop device which is constructed in such a manner that during the movement of the lid from the completely closed position into the completely open position, a movement direction for opening the lid must be changed at least partially in order to move the lid beyond the defined intermediate position.

2. A closure device for a container with a base element which can be fixed on an opening of the container and which has a dispensing opening, and with a lid which can be moved back and forth between a completely closed and a completely open position, characterised in that the closure device is constructed in such a manner that the lid has at least one defined intermediate position between the completely closed and the completely open position, wherein the intermediate position of the lid is defined by a location of the lid outwardly relative to the base element compared with the location of the lid relative to the base element when the lid is in the completely closed position, and wherein the closure device has at least one degassing channel, which is closed in the completely closed position of the lid and which, in the defined intermediate position of the lid, enables a pressure compensation between a side of the closure device which is to be brought to face an interior of the container and the ambient exterior environment, the closure device further characterised in that the lid comprises a sealing element, which in the closed position of the lid engages into the dispensing opening of the closure device and is connected to the latter in a sealing manner, and wherein the at least one degassing channel is defined by a recess on an external side of the sealing element of the lid.

3. A closure device for a container with a base element which can be fixed on an opening of the container and which has a dispensing opening, and with a lid which can be moved back and forth between a completely closed and a completely open position, characterised in that the closure device is constructed in such a manner that the lid has at least one defined intermediate position between the completely closed and the completely open position, wherein the intermediate position of the lid is defined by a location of the lid outwardly relative to the base element compared with the location of the lid relative to the base element when the lid is in the completely closed position, and wherein the closure device has at least one degassing channel, which is closed in the completely closed position of the lid and which, in the defined intermediate position of the lid, enables a pressure compensation between a side of the closure device which is to be brought to face an interior of the container and the ambient exterior environment, the closure device device further characterised in that the lid comprises at least one web on its inner side, on which web a stop element is constructed.

* * * * *